US005201431A

United States Patent [19]

Berger et al.

[11] Patent Number: 5,201,431

[45] Date of Patent: Apr. 13, 1993

[54] FRAGRANCE BOTTLE HAVING REMOVABLY AFFIXED JEWELRY TIMEPIECE

[76] Inventors: Joshua Berger, 14 Wallenberg Cir., Monsey, N.Y. 10952; Leon Weiss, 2792 Casiano Rd., Los Angeles, Calif. 90077

[21] Appl. No.: 901,570

[22] Filed: Jun. 19, 1991

[51] Int. Cl.[5] ..... B65D 23/12

[52] U.S. Cl. ..... 215/100 R; 285/915; 403/268; 403/292; 403/326; 368/278; 248/115

[58] Field of Search ..... 215/100 R, 1C; D10/1, D10/2; D9/337, 324; 248/114, 115, 116, 27.3; 368/216, 276, 278, 10; 220/890; 403/326, 267, 268, 292; 285/915

[56] References Cited

U.S. PATENT DOCUMENTS

| | | | |
|---|---|---|---|
| D. 43,827 | 4/1913 | Redlich | D9/324 |
| D. 94,618 | 2/1935 | Miedel | D9/324 |
| D. 185,991 | 8/1959 | Loewy | D10/2 |
| D. 314,308 | 2/1991 | Cogswell | D10/2 X |
| 1,327,051 | 1/1920 | Lewis | 248/116 |
| 1,471,797 | 10/1923 | Merrill et al. | 248/115 |
| 2,576,476 | 11/1951 | Peter et al. | 368/278 |
| 4,058,972 | 11/1977 | Weick | 368/278 |
| 4,227,594 | 10/1980 | Kluger | 248/27.3 X |
| 4,367,956 | 1/1983 | Windstey | 368/278 X |
| 4,627,683 | 12/1986 | Shimomura | 248/27.3 X |
| 4,742,500 | 5/1988 | Luce | 368/278 X |
| 4,769,799 | 9/1988 | Matsukage | 368/278 |
| 4,917,423 | 4/1990 | Kohn | 403/326 X |
| 5,082,390 | 1/1992 | Balsells | 403/326 |

*Primary Examiner*—Allan N. Shoap
*Assistant Examiner*—Christopher J. McDonald
*Attorney, Agent, or Firm*—Thomas I. Rozsa; Dong Chen

[57] ABSTRACT

The present invention is a fragrance bottle having a removably affixed timepiece ornament. The present invention includes a fragrance bottle having an exterior surface with a shallow depression. A mounting ring is nondetachably affixed to the fragrance bottle within the exterior depression by an adhesive agent. The timepiece is detachably attached to the mounting ring by inserting its base portion into the cavity of the mounting ring. The mounting ring has a self-contained spring member for securing the detachable engagement to the timepiece. The present invention can also be utilized on other bottles such as liquor bottles.

14 Claims, 2 Drawing Sheets

FIG. 1
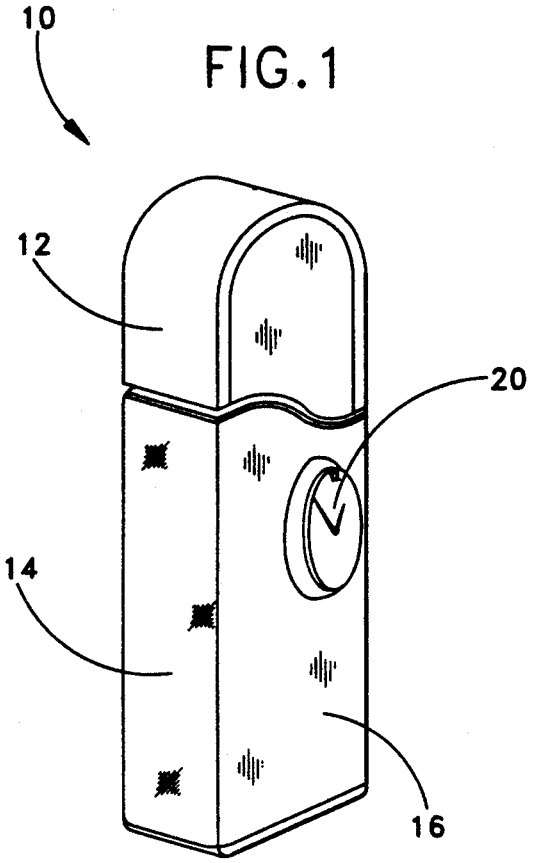
FIG. 4
(Section on line 4-4)
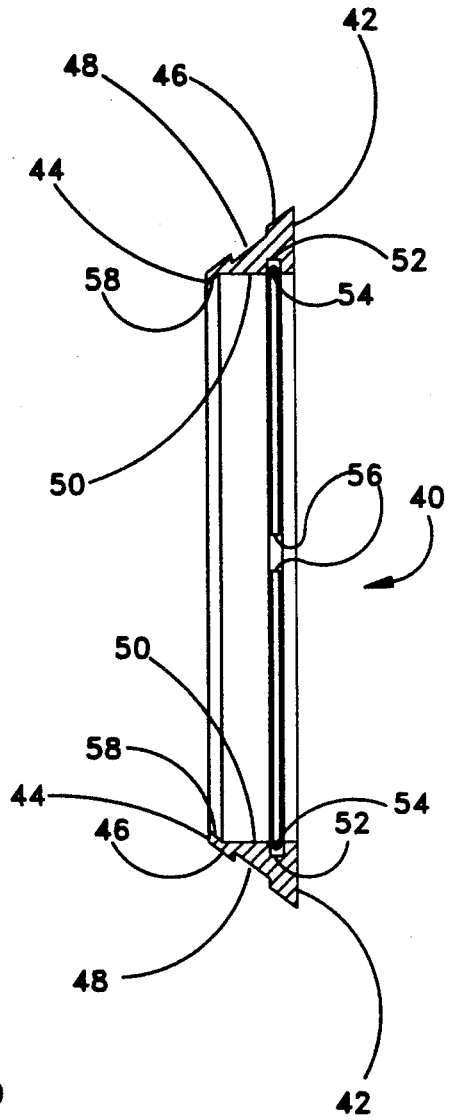
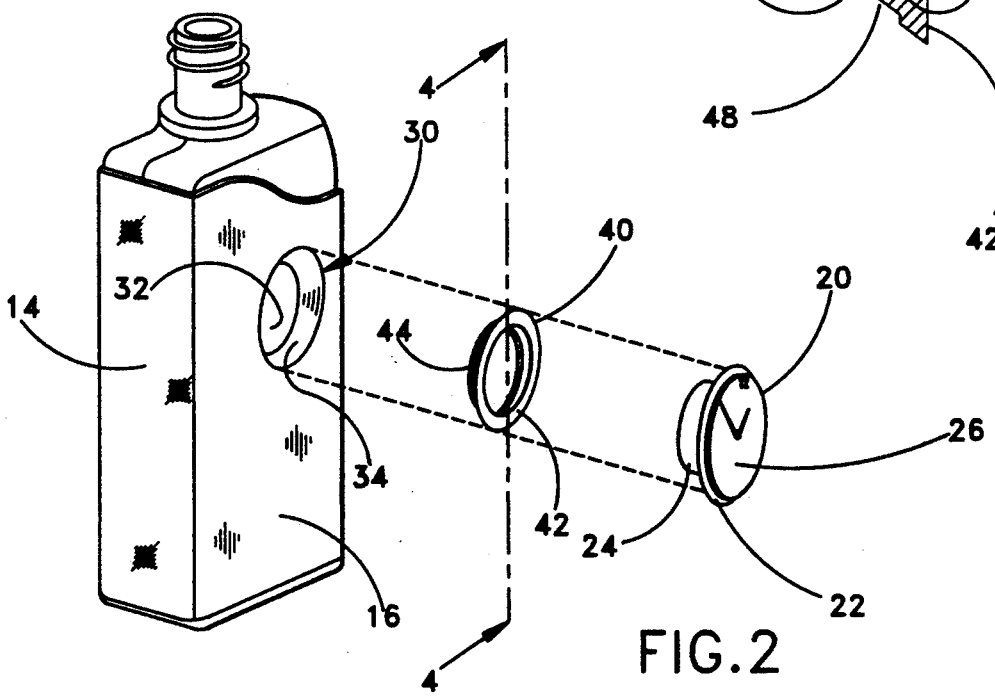
FIG. 2

FRAGRANCE BOTTLE HAVING REMOVABLY AFFIXED JEWELRY TIMEPIECE

BACKGROUND OF THE INVENTION

1. Field of The Invention

The present invention relates to the field of decorative containers. More particularly the present invention relates to the field of decorative small glass containers with jewelry timepieces affixed thereon.

2. Description of The Prior Art

Both luxurious fragrance containers which contain perfume, cologne, aftershave, etc. and fine jewelry timepieces have been around for centuries. Home use fragrance containers are often artistically designed small bottles made of high quality glass such as crystal glass. Such glass fragrance bottles are often elegantly decorated. However, no glass fragrance bottle has been found which is ornamented with a small jewelry timepiece.

There could be many reasons to explain why no such combination of fragrance bottle and jewelry timepiece has been invented to date. One possible reason may be that it is difficult to mount timepieces to fragrance bottles. Most fragrance bottles stand upright and the best location for mounting a timepiece is on the front surface of the fragrance bottle, so that the timepiece is vertically oriented and readily observable. However, since the casing of a jewelry timepiece is often made of solid metal such as brass or gold, it is not easy to attach the casing of the timepiece to the glass surface of the fragrance bottle.

Another possible reason may be that even though it might be conceivable to adhere the metal casing of a timepiece to the surface of a glass bottle with glue, such a non-removable manner of mounting is highly undesirable. A consumer should be able to take a timepiece off a fragrance bottle for various purposes, such as maintenance, repair, replacing the battery if it is an electronic timepiece, etc. In addition, the timepiece is often much more valuable than the glass bottle. The consumer should be able to remove the timepiece in case the glass bottle is damaged or no longer wanted, or after all of the fragrance contained in the bottle is removed, and use the timepiece on a new fragrance bottle.

Therefore, it will be desirable to have a unique combination of high class fragrance bottle and jewelry timepiece whether it be a fine jewelry timepiece or an inexpensive timepiece. It will be even more desirable to have the jewelry timepiece detachably and interchangeably mounted to the fragrance bottle.

SUMMARY OF THE INVENTION

The present invention is a fragrance bottle having a removably affixed jewelry timepiece ornament.

It is known that high class fragrance bottles are often artistically designed and decorated. It is also known that fine timepieces are often used for both practical and decorative purposes. However, there has previously been no combination of a fragrance bottle, whether ornamental or simple, and a jewelry timepiece, whether fine jewelry or inexpensive timepiece, where the timepiece is attached to the fragrance bottle in an interchangeable manner.

It is therefore a primary object of the present invention to provide a fragrance bottle with an interchangeable jewelry timepiece ornament. It is a further object of the present invention to provide such a fragrance bottle upon which the jewelry timepiece is securely but removably affixed.

It has been discovered, according to the present invention, that although the progress of modern technology has made it possible to produce very compact sized timepieces, the casings of such small timepieces still have to have a certain thickness, at least in its rear base portion, for housing the complicated mechanical or electronic components of the timepiece. Therefore, if the front surface of a fragrance bottle is made with a depressed basin, then the rear base portion of the timepiece can be retained within the depressed basin below the front surface of the fragrance bottle, which leaves only the front time displaying portion of the timepiece exposed at the front surface of the fragrance bottle.

It has also been discovered, according to the present invention, that since the fragrance bottle is usually made of glass and the casing of the timepiece is usually made of metal, it is hard to attach the rear base portion of the time piece directly to the sidewall or the bottom of the front basin of the fragrance bottle in a manner which is not only tight and secure but also releasible and removable. However, if an intermediate mounting ring is used, then it is possible to achieve both goals, because the intermediate mounting ring can be permanently secured within the front basin of the fragrance bottle and the rear base portion of the timepiece can be detachably mounted with the intermediate mounting ring.

It has been further discovered, according to the present invention, that if both the sidewall of the front basin of the glass fragrance bottle and the exterior sidewall of the mounting ring are tapered with the same slope, then they can not only be engaged into a thorough fit but also their contacting areas are substantially increased, which is highly beneficial for the adhesive bonding between them.

It has been additionally discovered, according the present invention, that if the tapered exterior sidewall of the mounting ring has an outer circular channel, then the glue material applied between the exterior sidewall of the mounting member and the sidewall of the front basin of the fragrance bottle can be more evenly spread through the outer circular channel and any excessive amount of glue material can be retained within the outer circular channel.

It has also been discovered, according to the present invention, that if the mounting ring has a straight interior sidewall for accommodating the rear base portion of the timepiece, but an inner circular channel is provided for retaining a spring wire, then when the rear base portion of the timepiece is inserted into the mounting ring, the spring wire will help to secure the attachment of the rear base portion of the timepiece.

It has further been discovered, according to the present invention, that although an intermediate mounting ring is utilized for the interchangeable mounting, the luxurious fragrance bottle with a jewelry timepiece will have a more beautiful appearance if the mounting ring is not visible and the jewelry timepiece appears to be directly attached to the fragrance bottle.

It is therefore another object of the present invention to provide a luxurious fragrance bottle decorated with a fine jewelry timepiece, where the front surface of the fragrance bottle has a depressed basin for receiving the rear base portion of the timepiece, so that only the front time displaying portion of the time piece is exposed at the front surface of the fragrance bottle.

It is also an object of the present invention to provide a fragrance bottle embellished with a jewelry timepiece, where an intermediate mounting ring is utilized to achieve the dual purpose of the attachment: that the timepiece is not only securely mounted but also detachable from the fragrance bottle. The timepiece can be mounted to the intermediate mounting ring releasibly, and then the intermediate mounting ring can be affixed to the fragrance bottle permanently.

It is a further object of the present invention to provide a fragrance bottle having a jewelry timepiece interchangeably mounted by a mounting ring, where the sidewall of the front basin of the bottle and the exterior sidewall of the mounting ring are both tapered with identical slopes, so that they can be completely engaged and their contacting surfaces are significantly increased, which will strengthen the adhesive bonding between them.

It is an additional object of the present invention to provide a fragrance bottle having a timepiece attached by a mounting ring, where the tapered exterior sidewall of the mounting ring has a circular channel for facilitating even spreading of glue material between the exterior sidewall of the mounting member and the sidewall of the front basin of the fragrance bottle to retain any excessive amount of glue material applied.

It is also an object of the present invention to provide a fragrance bottle with a timepiece affixed by a mounting ring, where the straight interior sidewall of the mounting ring has an inner circular channel for retaining a spring wire, such that when the rear base portion of the timepiece is attached within the mounting ring, the spring wire will act to secure the attachment.

It is a further object of the present invention to provide a beautiful combination of a luxurious fragrance bottle and a fine jewelry timepiece, where the front time displaying portion of the timepiece is widened for concealing the intermediate mounting ring, so that the jewelry timepiece appears to be attached to the fragrance bottle directly which gives the combination a more appealing appearance.

The present invention can be utilized with any type of bottle, such as a fragrance bottle and a liquor bottle. Although it is expected that the bottle used most often will be made of glass, any other material such as plastic or synthetic material which can retain fragrances, or other liquids such as liquor, are within the spirit and scope of the present invention. The fragrance bottle can retain any type of fragrance such as perfume, cologne, aftershave, eau de toilet, etc. The liquor bottle can retain any type of liquor such as wine, beer, hard liquor, wine cooler, etc. It is also anticipated that scented powder and even hair lotion may be retained. Additionally, although it is envisioned to use the present invention primarily with a bottle, any container such as one to retain powder is also within the spirit and scope of the present invention.

The present invention may incorporate any timepiece from simple inexpensive timepieces to expensive fine jewelry timepieces.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention fragrance bottle having a removably affixed timepiece ornament.

FIG. 2 is a perspective and exploded view of the present invention fragrance bottle having a removably affixed timepiece ornament.

FIG. 4 is a cross-sectional view taken along line 4—4 of FIG. 2.

DESCRIPTION OF THE PREFERRED EMBODIMENT

Figure 3:
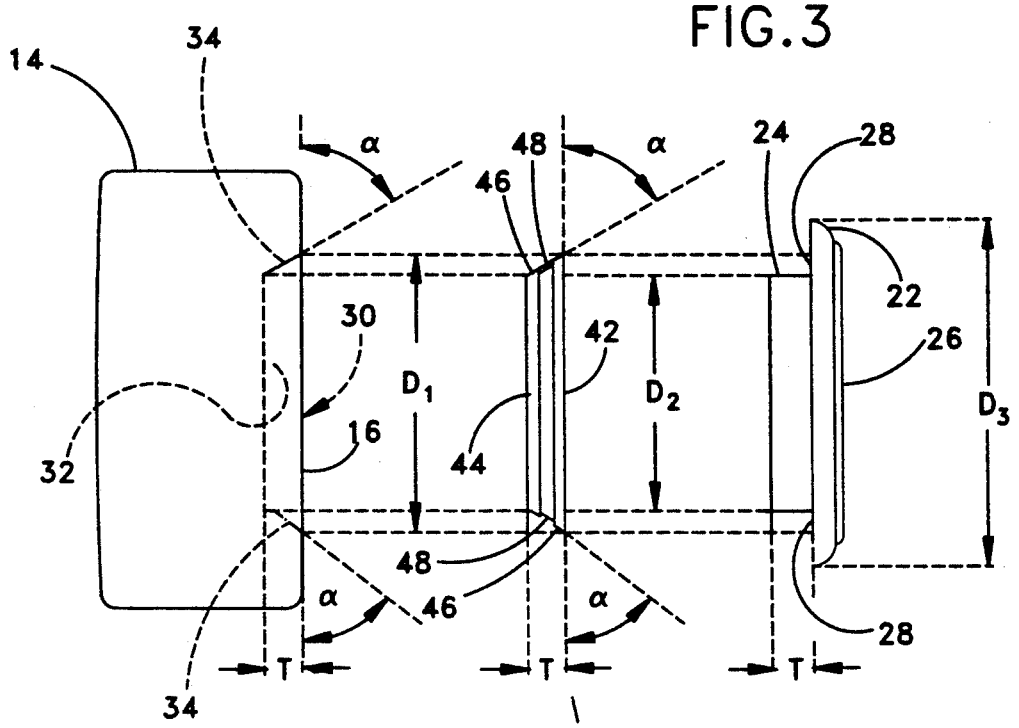
FIG. 3 is an exploded side view of the present invention fragrance bottle having a removably affixed timepiece ornament.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 10 the present invention fragrance bottle having a removably affixed timepiece ornament. The fragrance bottle usually comprises a cap 12 and a bottle 14. In the rest of the drawings, the fragrance bottle 14 is shown without the attachment of the cap 12. The fragrance bottle 14 has a generally flat front surface 16, upon which there is mounted a timepiece 20.

The fragrance bottle 14 is generally made of glass material. However, it will be appreciated that it may also be made of other suitable materials such as ceramics or plastics. In the preferred embodiment of the present invention, the fragrance bottle 14 is made of glass. It is also noted that although fragrance bottles may have numerous different kinds of configurations, they always have a respective front surface which faces the consumer. Of course the front surface may not always be flat. However, a timepiece may still be mounted on a non-flat front surface. The front surface may have a small area which is flat and large enough for mounting a relatively small timepiece, or alternatively, the casing of the timepiece may be made in conformity with the contour of the front surface. In addition, the timepiece 20 may be a traditional mechanism timepiece or an electronic timepiece.

Referring to FIG. 2, there is shown an exploded perspective view of the present invention fragrance bottle 14 and the removably affixed timepiece 20. The timepiece 20 has a widened front time displaying portion 22 and a cylindrical shaped rear base portion 24. A timing display is observable at the front surface 26 of the timepiece 20. A round basin 30 is provided on the front surface 16 of the fragrance bottle 14 for receiving the rear base portion 24 of the timepiece 20.

The rear base portion 24 of the timepiece 20 is not directly mounted within the circular basin 30 of the front surface 16 of the fragrance bottle 12. Rather, a unique circular mounting ring 40 is utilized for indirectly mounting the timepiece 20 to the fragrance bottle 14. It is the circular mounting ring 40 which is directly affixed within the basin 30 of the front surface 16 of the fragrance bottle 12. The timepiece 20 itself is then detachably attached to the circular mounting ring 40. The circular mounting ring 40 is preferably made of metal such as brass or aluminum or any other suitable material.

Referring to FIG. 3, there is shown an exploded side view to illustrate the precise craftsmanship of the present invention fragrance bottle 14, the circular mounting ring 40 and the timepiece 20. This precise craftsmanship guarantees not only a secure attachment but also an attractive appearance.

The round basin 30 at the front surface 16 of the fragrance bottle 14 has a generally flat bottom 32 and a tapered sidewall 34. The angle between the front surface 16 of the fragrance bottle 14 and the sidewall 34 of the round basin 30 is $\alpha$. The circular mounting ring has a front end 42, a rear end 44 and also a tapered exterior sidewall 46. The angle between the tapered exterior sidewall 46 and the front end 42 or rear end 44 is also $\alpha$. Therefore the slope of the exterior sidewall 46 of the circular mounting ring 40 is identical to the slope of the sidewall 34 of the front basin 30 of the fragrance bottle 14. The tapered configurations of the exterior sidewall 46 of the circular mounting ring 40 and the sidewall 34 of the front basin 30 of the fragrance bottle 14 will not only guarantee the complete contact between the two sidewalls, but also substantially increase the contacting area of the two sidewalls. In the preferred embodiment, the angle $\alpha$ is within the range of approximately 30 to 60 degrees.

The exterior sidewall 46 of the circular mounting ring 40 is affixed to the sidewall 34 of the front basin 30 of the fragrance bottle 14 by adhesive materials such as glues. The thorough fit and increased contacting area between the two sidewalls will greatly strengthen the adhesive bonding. The tapered exterior sidewall 46 of the circular mounting ring 40 is further provided with a circular outer channel 48. The circular outer channel 48 serves to facilitate the spreading of the adhesive material between the exterior sidewall 46 of the circular mounting ring 40 and the sidewall 34 of the front basin 30 of the fragrance bottle 14. The circular outer channel 48 further functions to retain any excessive adhesive material applied between the two sidewalls.

The precise craftsmanship of the present invention fragrance bottle 14, the circular mounting ring 40 and the timepiece 20 include not only the consistency in the respective slopes of the exterior sidewall 46 of the circular mounting ring 40 and the sidewall 34 of the front basin 30 of the fragrance bottle 14, but also the coherence in other dimensions of the various components. The diameter of the front end 42 of the circular mounting ring 40 and the diameter of the outward opening of the front basin 30 of the fragrance bottle 14 are approximately the same and equal D. In addition, the diameter of the cylindrical rear base portion 24 of the timepiece 20, the diameter of the rear end 44 of the circular mounting ring 40 and the diameter of the flat bottom 32 of the front basin 30 of the fragrance bottle 14 are all approximately the same and equal $D_2$. The diameter $D_3$ of the front time displaying portion 22 of the timepiece 20 may be larger than $D_1$ and $D_2$ and thus create a rearwardly facing circular shoulder 28. The purpose of this feature will be discussed in detail later. Furthermore, the thickness of the cylindrical rear base portion 24 of the timepiece 20, the thickness of the circular mounting ring 40 and the depth of the front basin 30 of the fragrance bottle 14 are all approximately the same and equal to T. The present invention fragrance bottle 14, the timepiece 20 and the circular mounting ring 40 are designed and manufactured with these consistent dimensions to ensure a matching attachment.

The circular mounting ring 40 is a unique aspect of the present invention. The exterior configuration of the circular mounting ring 40 has been described above. Referring to FIG. 4, there is shown the interior configuration of the circular mounting ring 40. The circular mounting ring 40 has a straight interior sidewall 50 which defines a cylindrical cavity for accomodating the cylindrical rear base portion 24 of the timepiece 20.

Adjacent to the front end 42 of the circular mounting ring 40, an inner circular channel 52 is provided on the straight interior sidewall 50 for retaining a spring wire 54. It is noted that the spring wire 54 is not a complete loop but rather is a U-shaped wire forming a nearly completed circle with a gap between its ends 56. This feature makes the spring wire 54 stretchable upon engagement with the rear base portion 24 of the timepiece 20. The inner circular channel 52 provides the necessary room for the spring wire 54 to expand. The spring tension of the spring wire 54 will ensure the tightened attachment between the circular mounting ring 14 and the rear base portion 24 of the timepiece 20.

Adjacent to the rear end 44 of the circular mounting ring 40, an inner circular flange 58 is provided on the straight interior sidewall 50. The inner circular flange 58 serves several purposes. It will provide a seating for the rear base portion 24 of the timepiece 20 once the latter is fully inserted into the circular mounting ring 40. The inner circular flange 58 also increases the area at the rear end 44 of the circular mounting ring 40 to increase its adhesive bonding with the front basin 30 of the fragrance bottle 14. The inner circular flange 58 may be further tapered. It is appreciated that the rear end 44 of the mounting ring could be completely sealed by a flat bottom.

Figure 5:
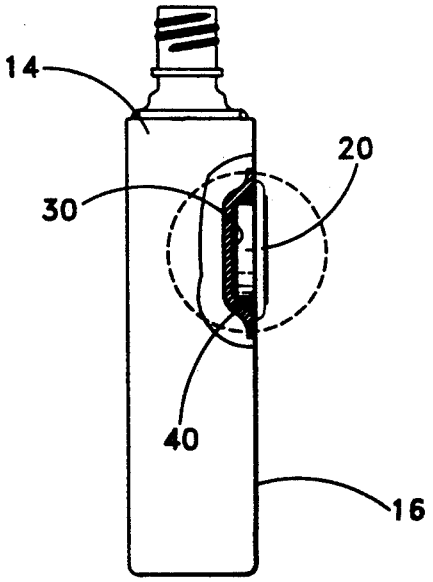
FIG. 5 is a side and partial cross-sectional view of the present invention fragrance bottle having a removably affixed timepiece ornament.
Figure 6:
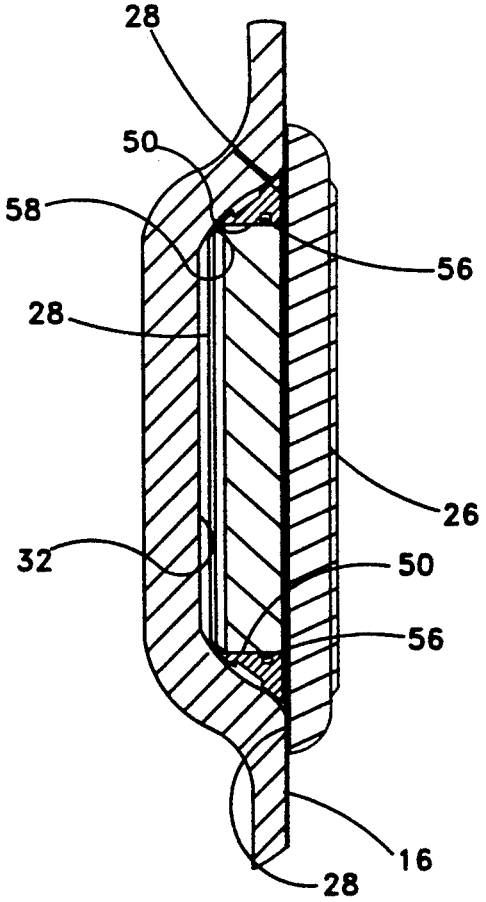
FIG. 6 is an enlarged and cross-sectional view of the dotted portion 6 of FIG. 5.

As illustrated in FIGS. 5 and 6, the circular mounting ring 40 and the timepiece 20 are fully attached to the fragrance bottle 14. Once fully assembled, only the front time displaying portion 22 of the timepiece 20 is exposed. The rearwardly facing circular shoulder 28 rests flush against the front surface 16 of the fragrance bottle 14 and conceals the circular mounting ring 40 completely, making the timepiece 20 seem to be directly attached to the fragrance bottle 14.

The present invention has many advantageous features. These features include: (a) it provides a luxurious fragrance container with a jewelry timepiece ornament which may be a fine jewelry timepiece; (b) it also provides a luxurious fragrance container upon which the timepiece is securely but interchangeably attached; (c) it further provides a luxurious fragrance bottle with a depressed basin on its front surface for receiving the rear base portion of the timepiece, so that only the front time displaying portion of the timepiece is exposed at the front surface of the fragrance bottle; (d) it additionally provides an intermediate mounting ring so that the timepiece can be releasibly mounted to the intermediate mounting ring, and the intermediate mounting ring can be permanently affixed to the fragrance bottle; (e) it also provides a mounting ring which matches the front basin of the fragrance bottle, where the sidewall of the front basin of the fragrance bottle and the exterior sidewall of the mounting ring are both tapered with identical slopes, so that they can not only match completely, but also their contacting surfaces are significantly increased, which in turn strengthens the adhesive bonding between them; (f) it further provides a circular channel for facilitating even spreading of glue material between the exterior sidewall of the mounting member and the sidewall of the front basin of the fragrance bottle and retaining any excessive amount of glue material applied; (g) it additionally provides an inner circular channel at the straight interior sidewall of the mounting ring for retaining a spring wire, which in turn serves to secure the attachment between the rear base portion of the timepiece and the mounting ring; and (h) it further provides a widened front time displaying portion for concealing the circular mounting ring, so that the jewelry timepiece appears to be directly attached to the fragrance bottle which gives the combination a more attractive appearance.

The timepiece 20 may be a fine jewelry timepiece which includes a fine watch movement and perhaps even precious gems on the watch face or bezel or it may be a simple inexpensive timepiece. The fragrance bottle 10 may be a bottle which retains perfume, eau de toilet, cologne, aftershave, etc. The bottle 10 may be designed in a very stylistic design as illustrated in FIG. 1 or it can be a conventional simple shape.

Through use of the present invention, the user can be applying fragrance in the morning or evening and be able to tell time so he or she knows how much more time they have before they have to leave for their appointment, work, etc. The unique mounting ring 40 is permanently affixed to the bottle 10 but the novel spring ring 54 provides a secure means to retain the base 24 of the timepiece within the mounting ring 40 so that the timepiece will not become loose during vigorous shaking of the bottle 10 while the fragrance is being applied.

In addition, the unique mounting ring arrangement allows the timepiece 20 to be removed by a strong pulling force. In this way, after the fragrance has been used up, the user can buy a replacement fragrance bottle with mounting ring 40 and remove the timepiece 20 from the used bottle 10 and push it into the mounting ring 40 of the new bottle.

Furthermore, the present invention may be also utilized in liquor bottles, such as wine bottles, beer bottles, hard liquor bottles and wine cooler bottles, etc. A timepiece attached on a liquor bottle provides not only an attractive ornament but also serves a practical purpose. Again, the user of the present invention can uninterruptedly be aware of the time while consuming liquor. The timepiece attached to the liquor bottle can continuously remind a consumer of the present time so the consumer may promptly go back home or to work or other important appointment. In addition, the detachable mounting of the timepiece makes it possible for the consumer or bartender to interchange the timepiece when the liquor bottle is empty.

Defined in detail, the present invention is a luxurious glass fragrance bottle having a removably affixed fine jewelry timepiece ornament, comprising: (a) a luxurious glass fragrance bottle having a flat front surface, the front surface having a round shallow basin, and the basin having a flat bottom and a tapered sidewall; (b) a metallic circular mounting ring having a front end, a rear end, a tapered exterior sidewall and a straight interior sidewall, the thickness of the mounting ring being substantially the same as the depth of said front basin of said bottle, the rear end having substantially the same diameter as said bottom of said front basin of said bottle, the tapered exterior sidewall substantially conforming with said tapered sidewall of said front basin of said bottle, and the straight interior sidewall defining a cylindrical cavity; (c) a fine jewelry timepiece having a metallic casing, the casing having a front time displaying portion and a cylindrical rear base portion, the rear portion having substantially the same diameter as said cavity of said mounting ring and substantially the same thickness as said mounting ring; (d) said mounting ring permanently affixed to said bottle within said front basin by glue material; (e) said timepiece removably attached to said mounting ring by inserting said rear portion of said casing of said timepiece into said cavity of said mounting ring; and (f) means for securing the engagement between said casing of said timepiece and said mounting ring; (g) whereby said timepiece is securely yet interchangeably attached to said front surface of said fragrance bottle, which provides a unique combination of luxurious glass fragrance bottle and fine jewelry timepiece.

Defined broadly, the present invention is a fragrance bottle having a removably affixed timepiece ornament, comprising: (a) a fragrance bottle having a generally flat front surface, the front surface having a shallow basin, and the basin having a generally flat bottom and a tapered sidewall; (b) a mounting ring having a front end, a rear end, a tapered exterior sidewall and a straight interior sidewall defining a cavity, the tapered exterior sidewall substantially conforming with said tapered sidewall of said front basin of said bottle; (c) a timepiece having a casing, the casing having a front time displaying portion and a rear base portion, the rear portion substantially conforming with said cavity of said mounting ring; (d) means for permanently affixing said mounting ring to said bottle within said front basin; and (e) said timepiece removably attached to said mounting ring by inserting said rear base portion of said casing of said timepiece into said cavity of said mounting ring; (f) whereby said timepiece is securely yet interchangeably attached to said front surface of said fragrance bottle, which provides a unique combination of a fragrance bottle and a fine jewelry timepiece.

Defined more broadly, the present invention is a fragrance bottle having a timepiece ornament, comprising: (a) a fragrance bottle having an exterior surface with a shallow depression; (b) a mounting member having an exterior configuration and an interior cavity, the exterior configuration substantially conforming with said exterior depression of said bottle; (c) a timepiece having a casing with a base portion, the base portion substantially conforming with said cavity of said mounting member; (d) means for nondetachably affixing said mounting member to said bottle within said depression; and (e) said timepiece attached to said mounting member by inserting said base portion of said casing of said timepiece into said cavity of said mounting member; (f) whereby said timepiece is securely attached to said exterior surface of said fragrance bottle which provides a unique combination of a bottle and timepiece.

Defined even more broadly, the present invention is a fragrance container ornamented with a timepiece, comprising a fragrance container, a mounting member non-detachably affixed to said container, and a timepiece detachably attached to said mounting member, whereby said timepiece is securely yet interchangeably attached to said fragrance container.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A fragrance bottle having a removably affixed timepiece ornament, comprising:

a. a glass fragrance bottle having a flat front surface, the front surface having a round shallow basin, and the front basin having a flat bottom and a tapered sidewall;

b. a metallic circular mounting ring having a front end, a rear end, a tapered exterior sidewall and a straight interior sidewall, the thickness of the mounting ring being substantially the same as the depth of said front basin of said bottle, the rear end having substantially the same diameter as said bottom of said front basin of said bottle, the tapered exterior sidewall substantially conforming with said tapered sidewall of said front basin of said bottle, and the straight interior sidewall defining a cylindrical cavity;

c. a timepiece having a metallic casing, the casing having a front time displaying portion and a cylindrical rear base portion, the rear portion having substantially the same diameter as said cavity of said mounting ring and substantially the same thickness as said mounting ring;

d. said mounting ring permanently affixed to said bottle within said front basin by adhesive material, wherein said tapered exterior sidewall of said circular mounting ring further has an outer circular channel for facilitating the spreading of said adhesive material and retaining any excessive adhesive material applied between said tapered exterior sidewall of said circular mounting ring and said tapered sidewall of said front basin of said fragrance bottle;

e. said timepiece removably attached to said mounting ring by inserting said base portion of said casing of said timepiece into said cavity of said mounting ring; and f. means for securing the engagement between said casing of said timepiece and said mounting ring;

g. whereby said timepiece is securely yet interchangeably attached to said front surface of said fragrance bottle, which provides a unique combination of a glass fragrance bottle and a timepiece.

2. The invention as defined in claim 1 wherein said means for securing the engagement between said casing of said timepiece and said mounting ring includes a spring means retained within said cavity of said mounting ring and having a spring tension for ensuring a tightened attachment between said casing of said timepiece and said mounting ring.

3. The invention as defined in claim 2 wherein said spring means is an elongated spring wire having two ends, the spring wire forming a circular configuration with its two ends separated by a small gap.

4. The invention as defined in claim 3 wherein said spring wire is retained by an inner circular channel on said interior sidewall of said circular mounting ring.

5. The invention as defined in claim 1 wherein said front time display portion of said casing of said timepiece is widened for concealing said mounting ring when said timepiece is attached to said bottle.

6. A fragrance bottle having a removably affixed timepiece ornament, comprising:

a. a fragrance bottle having a generally flat front surface, the front surface having a shallow basin, and the basin having a generally flat bottom and a tapered sidewall;

b. a mounting ring having a front end, a rear end, a tapered exterior sidewall and a straight interior sidewall defining a cavity, the tapered exterior sidewall substantially conforming with said tapered sidewall of said front basin of said bottle;

c. a timepiece having a casing, the casing having a front time displaying portion and a rear base portion, the rear base portion substantially conforming with said cavity of said mounting ring;

d. means for permanently affixing said mounting ring to said bottle within said front basin, wherein said means for permanently affixing said mounting ring to said fragrance bottle within said front basin includes an adhesive agent, and said tapered exterior sidewall of said mounting ring further has an outer channel for facilitating the spreading of said adhesive agent and retaining any excessive adhesive agent applied between said tapered exterior sidewall of said mounting ring and said tapered sidewall of said front basin of said fragrance bottle; and e. said timepiece removably attached to said mounting ring by inserting said rear base portion of said casing of said timepiece into said cavity of said mounting ring;

f. whereby said timepiece is securely yet interchangeably attached to said front surface of said fragrance bottle, which provides a unique combination of a fragrance bottle and a timepiece.

7. The invention as defined in claim 6 wherein said fragrance bottle is made of glass material.

8. The invention as defined in claim 6 wherein said mounting ring is made of metallic material.

9. The invention as defined in claim 6 wherein said casing of said timepiece is made of metallic material.

10. The invention as defined in claim 6 further comprising means for securing the engagement between said casing of said timepiece and said mounting ring.

11. The invention as defined in claim 10 wherein said means for securing the engagement between said casing of said timepiece and said mounting ring includes a spring means retained within said cavity of said mounting ring and having a spring tension for ensuring a tightened attachment between said casing of said timepiece and said mounting ring.

12. The invention as defined in claim 11 wherein said spring means is a compressible spring wire.

13. The invention as defined in claim 11 wherein said spring means is retained by an inner channel on said interior sidewall of said mounting ring.

14. The invention as defined in claim 6 wherein said front time display portion of said casing of said timepiece is widened for concealing said mounting ring when said timepiece is attached to said fragrance bottle.

* * * * *